United States Patent [19]

McNeill et al.

[11] 4,266,162

[45] May 5, 1981

[54] ELECTROMAGNETIC DISCHARGE APPARATUS WITH DOUBLE-ENDED POWER COUPLING

[75] Inventors: William H. McNeill, Carlisle; Alfred E. Feuersanger, Framingham; Paul O. Haugsjaa, Acton; Robert J. Regan, Needham, all of Mass.

[73] Assignee: GTE Laboratories Incorporated, Waltham, Mass.

[21] Appl. No.: 21,125

[22] Filed: Mar. 16, 1979

[51] Int. Cl.[3] ..... H01J 7/46; H01J 11/80

[52] U.S. Cl. ..... 315/39; 315/248; 333/24 C

[58] Field of Search ..... 315/248, 39; 333/24, 333/24 C

[56] References Cited

U.S. PATENT DOCUMENTS

| | | | |
|---|---|---|---|
| 3,911,318 | 10/1975 | Spero et al. | 315/39 |
| 3,942,068 | 3/1976 | Haugsjaa et al. | 315/39 |
| 3,943,401 | 3/1976 | Haugsjaa et al. | 315/39 |
| 3,943,402 | 3/1976 | Haugsjaa et al. | 315/248 |
| 3,943,403 | 3/1976 | Haugsjaa et al. | 315/39 |
| 3,993,927 | 11/1976 | Haugsjaa et al. | 315/248 |
| 3,995,195 | 11/1976 | Haugsjaa et al. | 315/248 |
| 3,997,816 | 12/1976 | Haugsjaa et al. | 315/248 |
| 4,001,631 | 1/1977 | Haugsjaa et al. | 315/248 |
| 4,001,631 | 1/1977 | McNeill et al. | 315/39 |
| 4,001,632 | 1/1977 | Regan et al. | 315/248 |
| 4,002,943 | 1/1977 | McNeill et al. | 315/248 |
| 4,002,944 | 1/1977 | McNeill et al. | 315/248 |
| 4,041,352 | 8/1977 | McNeill et al. | 315/248 |
| 4,053,814 | 10/1977 | Regan et al. | 315/248 |
| 4,065,701 | 12/1977 | Haugsjaa et al. | 315/248 |

*Primary Examiner*—Saxfield Chatmon, Jr.

*Attorney, Agent, or Firm*—William R. McClellan

[57] ABSTRACT

An electromagnetic discharge apparatus has a power coupling fixture which couples power to both ends of an electrodeless discharge vessel and produces a substantially uniform arc. Power can be coupled to the fixture from two high frequency power sources or can be coupled from a single high frequency power source by using a power divider. If power is coupled to the electrodeless discharge vessel from a single source, power transfer to the vessel is optimized when the electrical length of the circuit is an integral number of wavelengths. In an alternative embodiment, a second coupler is utilized in a conventional electrodeless light source to shape the electric fields and produce a more uniform arc.

15 Claims, 4 Drawing Figures

ELECTROMAGNETIC DISCHARGE APPARATUS WITH DOUBLE-ENDED POWER COUPLING

BACKGROUND OF THE INVENTION

Electrodeless light sources which operate by coupling high frequency power to a high pressure arc discharge in an electrodeless lamp have been developed. These light sources typically include a high frequency power source connected to a termination fixture with an inner conductor and an outer conductor surrounding the inner conductor as described in U.S. Pat. No. 3,942,058 issued Mar. 2, 1976 to Haugsjaa et al. and U.S. Pat. No. 3,942,068 issued Mar. 2, 1976 to Haugsjaa et al. The electrodeless lamp is positioned at the end of the inner conductor and acts as a termination load for the fixture. The termination fixture has the function of matching the impedance of the electrodeless lamp during high pressure discharge to the output impedance of the high frequency power source. Thus, when the high pressure discharge reaches steady state, a high percentage of input high frequency power is absorbed by the discharge in the electrodeless lamp.

Previous patents describe electrodeless light sources wherein the termination fixture couples power to one end of the electrodeless lamp. While light sources with single-ended coupling give generally satisfactory results, they have certain disadvantages. In the situation where power is coupled to one end of the lamp and the other end is open-circuited, the electric field in the lamp decreases with increasing distance from the power coupling conductor. As a result, arc intensity also decreases with increasing distance from the power coupling conductor.

Non-uniform arcs are undesirable for several reasons. They produce both hotspots and coldspots in the wall of the lamp envelope. Hotspots occur adjacent to points of maximum arc intensity and at points where the arc attaches to the lamp envelope. The envelope wall material has a maximum operating temperature. Therefore, the total power which can be delivered to the lamp without exceeding the maximum temperature is reduced by the existence of hotspots. The light output of the lamp is correspondingly lowered. Moreover, for a given value of input power, the life of the lamp is reduced when hotspots occur. Coldspots occur at the points on the lamp wall which are most distant from the arc and are undesirable because fill material can condense on the lamp envelope at coldspots and can block a portion of the light output by absorption. Conversely, a more uniform arc results in a more uniform wall temperature and a higher level of input power and light output can be achieved. Also, the life of the lamp is increased when temperature variations over the wall of the lamp are minimized.

It is frequently desirable to use elongated light sources. For example, elongated fluorescent lamps are commonly used in homes and offices. Also, elongated light sources are used in various scientific applications such as in laser pumping. In the case of electrodeless lamps with single ended power coupling, the intensity of the arc decreases as a function of distance from the power coupling conductor. Electrodeless lamps of more than a few centimeters in length are, for this reason, impractical. The arc can be extended by increasing the input power. However, the problems of high lamp wall temperatures and of attachment of the arc to the lamp wall place limitations on input power increases.

Longer electrodeless lamps could more easily be achieved if the arc intensity was uniform.

Another problem with single ended coupling relates to the orientation of the lamp during discharge. The optimum orientation for single ended coupling is with the lamp in a vertical position and with power coupled from the bottom. In this position, heat generated by the arc is carried upwards in the lamp by convection currents which have the additional effect of extending the arc upwards, thereby increasing its length. This effect is reversed if power is coupled to the lamp from its top. Convection currents again carry heat upwards in the lamp, but the effect is to shorten the arc which extends downward from the power coupling conductor. Convection currents have an effect on the arc whatever the orientation of the lamp. Thus, the performance of lamps with single ended coupling varies with orientation. Since light sources are normally required to operate in a variety of orientations, it would be desirable to construct an electrodeless light source wherein the susceptibility to changes in orientation is reduced.

SUMMARY OF THE INVENTION

According to the present invention, an electromagnetic discharge apparatus is provided in which high frequency power is coupled to both ends of an electrodeless discharge vessel. The apparatus includes electrodeless discharge and a power coupling fixture. The electrodeless discharge means includes a discharge vessel having a first end and a second end and contains a fill material which supports electromagnetic discharge.

The power coupling fixture is operative to couple high frequency power to both ends of the electrodeless discharge means so that said discharge means forms a termination load for said fixture during operation. The power coupling fixture includes a first conductor, a second conductor, and an outer conductor. The first conductor has a first end coupled to the first end of the discharge vessel and a second end. The second conductor has a first end coupled to the second end of the discharge vessel and a second end. The outer conductor is disposed around the first and second conductors and the electrodeless discharge means. The outer conductor has a first end associated with the second end of said first conductor to form a first input for receiving high frequency power and has a second end associated with the second end of said second conductor to form a second input for receiving high frequency power.

According to another aspect of the present invention, an electromagnetic discharge apparatus includes electrodeless discharge means and a power coupling fixture as above described and further includes first transmission circuit means, second transmission circuit means, and power divider means. The first transmission circuit means has an output coupled to the first input of the power coupling fixture and an input. The second transmission circuit means has an output coupled to the second input of the power coupling fixture and an input. The power divider means has a first output coupled to the input of said first transmission circuit means, a second output coupled to the input of said second transmission circuit means, and an input which is operative to receive high frequency power.

According to still another aspect of the present invention, an electromagnetic discharge apparatus includes electrodeless lamp means having a lamp envelope made of a light transmitting substance and a power coupling fixture operative to couple high frequency power to the electrodeless lamp means so that said lamp means forms a termination load for the fixture during discharge. The lamp envelope has a first end and a second end and encloses a fill material which emits light during electromagnetic discharge. The power coupling fixture includes a first conductor, a second conductor, and an outer conductor. The first conductor has a first end coupled to the first end of the lamp envelope and a second end. The second conductor has a first end coupled to the second end of the lamp envelope and a second end. The outer conductor is disposed around the first and second conductors and the electrodeless lamp means. The outer conductor has a first end associated with the second end of the first conductor to form an input for receiving high frequency power and is coupled to the second end of the second conductor so that a substantially uniform discharge is produced in the electrodeless lamp.

DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
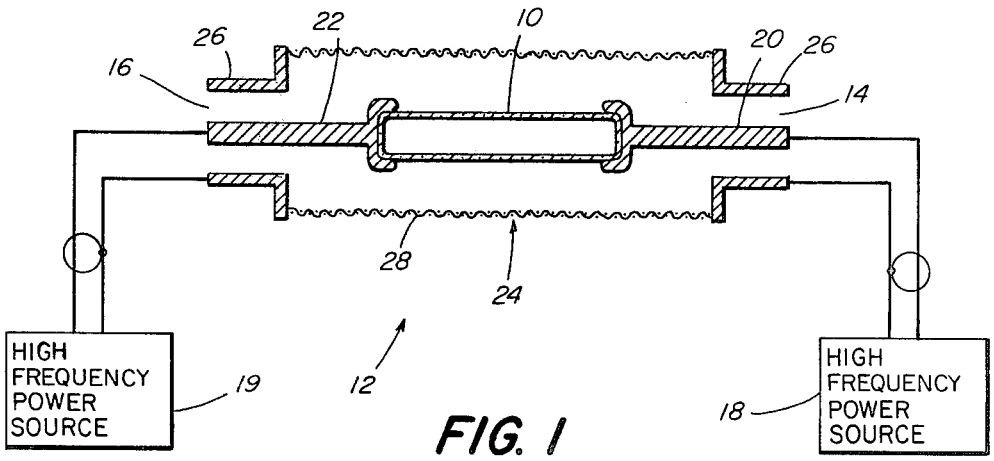
FIG. 1 is a sectional view of an electrodeless light source according to the present invention utilizing two high frequency power sources.

An electromagnetic discharge apparatus in accordance with the present invention is shown in FIG. 1 as an electrodeless light source. Other applications of the apparatus are described hereinafter. The apparatus includes electrodeless discharge means having a discharge vessel which contains a fill material capable of supporting electromagnetic discharge. Referring now to FIG. 1, the light source includes electrodeless discharge means shown as electrodeless lamp 10 having a discharge vessel or lamp envelope made of a light transmitting substance, such as quartz. The lamp envelope encloses a fill material which emits light during electromagnetic discharge. The apparatus source also includes a power coupling fixture 12 which couples high frequency power to both ends of the electrodeless lamp 10 and provides a means for excitation of the discharge in the electrodeless lamp 10. The power coupling fixture 12 has a first input 14 and a second input 16 for receiving high frequency power. The frequency of operation is in the range from 100 MHz to 300 GHz and typically is in the ISM (Industrial, Scientific and Medical) band between 902 MHz and 928 MHz. One preferred operating frequency is 915 MHz. First input 14 is connected to high frequency power source 18. Second input 16 is connected to high frequency power source 19. High frequency power sources 18 and 19 can be an AIL Tech. Power Signal Source, type 125. In this case the connections to first input 14 and second input 16 are by coaxial cable. At this and other frequencies of operation connection can be made either by waveguide or by other transmission line. A high frequency power source designed for use with electrodeless light sources was disclosed in U.S. Pat. No. 4,070,603 issued Jan. 24, 1978 to Regan et al. and can be used as the power sources 18 and 19 in the present invention.

The power coupling fixture 12 includes a first conductor 20, a second conductor 22 and an outer conductor 24. The fixture 12 typically has a coaxial configuration with the first conductor 20 and second conductor 22 in the center and the outer conductor 24 surrounding the first conductor 20 and the second conductor 22. The first conductor 20 has one end coupled to one end of the electrodeless lamp 10. The opposite end of the first conductor 20 forms the first conductor of the first input 14. The second conductor 22 has one end coupled to the other end of the electrodeless lamp 10 as shown in FIG. 1. The opposite end of the second conductor 22 forms the first conductor of the second input 16. The outer conductor 24 is disposed around the first conductor 20, the electrodeless lamp 10, and the second conductor 22. The outer conductor 24 can be generally cylindrical in shape. One end of the outer conductor 24 forms the second conductor of the first input 14 and the opposite end of the outer conductor 24 forms the second conductor of the second input 16. The outer conductor 24 includes end conductors 26 and conductive mesh 28. At least a portion of the outer conductor 24 must be conductive mesh 28 or other conductive material which permits light produced by the discharge to escape the fixture 12.

The impedance of lamp 10 during discharge can be matched to the impedance of the high frequency power source using impedance matching elements in the power coupling fixture 12. For example, shunt capacitors can be placed at the ends of the fixture 12 as described in U.S. Pat. No. 3,943,403 issued Mar. 9, 1976 to Haugsjaa et al. Also, impedance matching can be achieved by utilizing helical couplers to couple first conductor 20 and second conductor 22 to electrodeless lamp 10 as shown in U.S. Pat. No. 3,943,404 issued Mar. 9, 1976 to McNeill et al. The shapes of first conductor 20 and second conductor 22 are important in achieving a uniform arc while avoiding attachment of the arc to the lamp envelope. Desirable shapes for power coupling conductors were disclosed in U.S. Pat. No. 3,942,068 issued Mar. 2, 1976 to Haugsjaa et al.

A power coupling fixture according to the present invention was constructed using brass for the first and second conductors. The outer conductor was a 1½ inch diameter cylindrical structure having brass end conductors and an electrically conductive mesh surrounding the lamp. The inputs of the fixture utilized type N coaxial connectors.

A cylindrical electrodeless lamp for use in the above-described fixture was constructed of quartz. The lamp had hemispherical end caps, was 7 cm long by 1 cm diameter, and had 1 mm wall thickness. The fill material was 100 torr of argon. A second type of electrodeless lamp for use in the above-described fixture employed a sapphire envelope, 7 cm long by 1 cm in diameter with 1 mm wall thickness. The end caps were polycrystalline alumina fused to the sapphire with a frit seal. The fill material was 325 torr of xenon and 10 milligrams of potassium.

In operation, the high frequency power delivered to the first input 14 and the second input 16 of the power coupling fixture 12 produces inside the lamp envelope a high frequency electric field which is sufficient to maintain discharge in the fill material. The discharge acts as a termination load for both power sources. High frequency power is converted to light and heat. In comparison with single-ended coupling fixtures, a more uniform arc is achieved in the present invention. Also, longer lamps can be uniformly excited.

Figure 2:
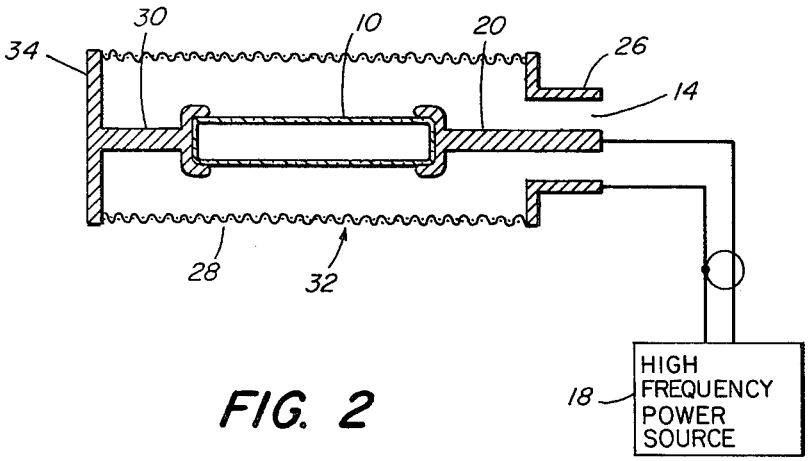
FIG. 2 is a sectional view of an electrodeless light source according to the present invention utilizing a second coupling conductor for field shaping.

Another preferred embodiment of the present invention is shown in FIG. 2. The double-ended power coupling principle is applied to the single-ended power coupling configuration to improve performance. Referring now to FIG. 2, the power coupling fixture includes a first conductor 20 coupled to one end of the electrodeless lamp 10. A second conductor 30 is coupled to the opposite end of electrodeless lamp 10. Outer conductor 32 includes end conductor 26 and conductive mesh 28, as previously described, and also includes conductor 34 which covers the end of the light source opposite the input end. End conductor 26, conductive mesh 28, and conductor 34 are coupled together to form a single outer conductor 32 which surrounds the electrodeless lamp 10. Second conductor 30 is coupled to conductor 34. First input 14 receives high frequency power from high frequency power source 18. Second conductor 30 acts to shape the electric fields in electrodeless lamp 10 for a more uniform arc distribution. Without second conductor 30, the non-excited end of electrodeless lamp 10 tends to be poorly excited, since this end of the lamp is at an open circuit and the current is reduced. Use of the second conductor 30 places this end of the lamp at a short circuit, where the current is high. Performance is optimized by adjusting the length and diameter of second conductor 30. The shape of second conductor 30 is also of importance in avoiding arc attachment as described above.

The improvement in performance obtained by coupling the non-excited end of an electrodeless lamp to the outer conductor can be accomplished in several ways with similar effect. FIG. 2 shows a second conductor 30 which has been designed to permanently couple the electrodeless lamp 10 to the outer conductor 32. In FIG. 1, the high frequency power source 19 can be removed from the second input 16 and the two conductors of second input 16 can be connected by a conductor (not shown). This produces a configuration which is electrically equivalent to that shown in FIG. 2. A conductor which is equivalent to second conductor 30 can be used in known electrodeless light sources, such as those shown in U.S. Pat. No. 3,942,068, in order to improve arc uniformity.

While the double-ended power coupling configuration shown in FIG. 1 gives generally satisfactory results, it is desirable to construct an electrodeless light source which retains the features described hereinabove but which utilizes a single high frequency power source. Also, balancing the power flow into the two ends of the lamp is difficult in the configuration of FIG. 1. The preferred embodiment of the present invention shown in FIG. 3 meets these requirements. A power divider 40 receives power at input 42 from high frequency power source 18 and divides the input power between a first output 44 and a second output 46. The power divider 40 can be an unmatched coaxial tee. A matched power splitter can be used, but is not required. The first output 44 of the power divider 40 is connected to the input of variable phase shifter 50. The output of phase shifter 50 is connected to the first input 14 of power coupling fixture 12 which contains electrodeless lamp 10 as previously described. The second output 46 of the power divider 40 is connected to the input of variable phase shifter 52. The output of phase shifter 52 is connected to the second input 16 of power coupling fixture 12. The variable phase shifters 50 and 52 can be Narda Model 3752. The interconnections between power coupling fixture 12, variable phase shifters 50 and 52, power divider 40 and high frequency power source 18 are typically made by coaxial cable such as RG/8.

Figure 3:
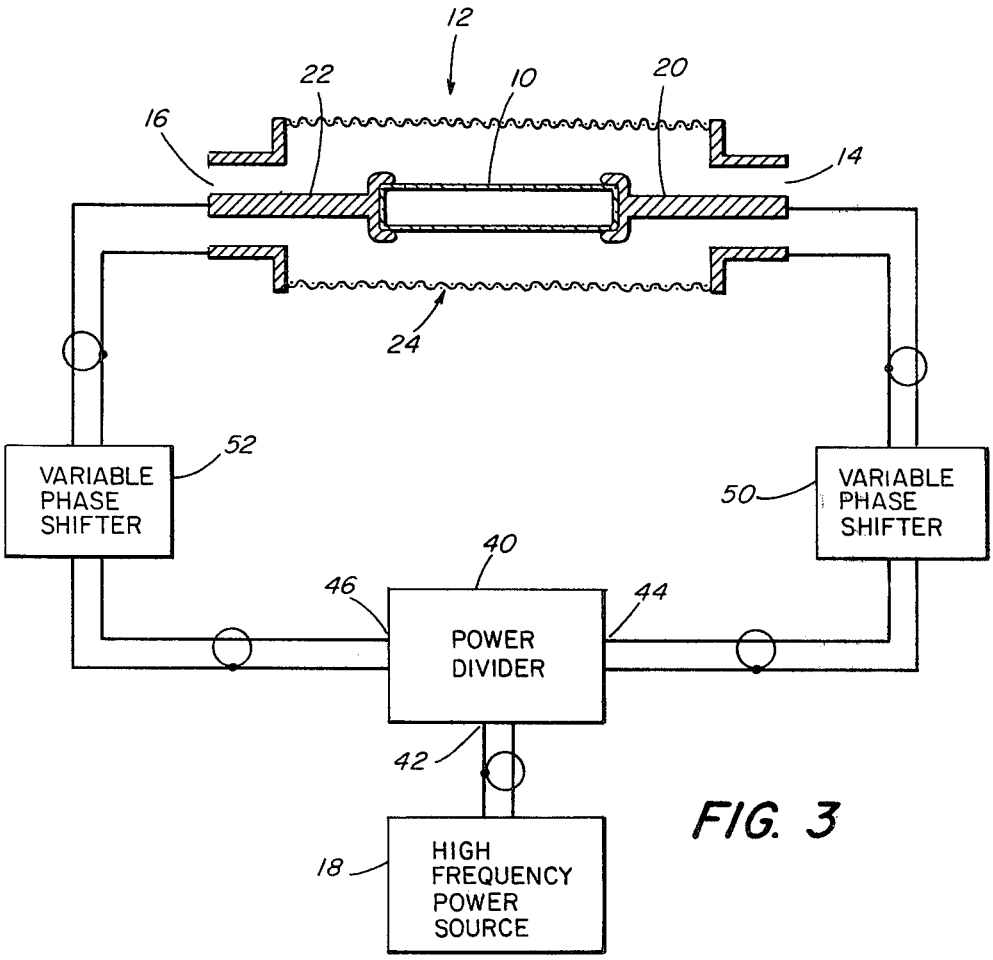
FIG. 3 is a sectional view of an electrodeless light source according to the present invention utilizing a resonant ring structure with variable phase shifters.

The structure shown in FIG. 3 is known as a resonant ring structure if certain electrical length requirements to be discussed hereinafter are met. It is used to optimize transfer of power from the power source 18 to electrodeless lamp 10. The resonant ring was first developed to simulate high power traveling wave conditions using a low power source and was described by Tischer, F. J., in "Resonance Properties of Ring Circuits", IRE Trans. on MTT, January 1957, pp. 51–56. The resonant ring is formed by an electrical circuit which forms a closed loop or ring fed at one point on the ring by a power source 18. Power is fed into the ring through power divider 40. The ring is formed by variable phase shifter 50, first conductor 20, electrodeless lamp 10, second conductor 22, variable phase shifter 52, power divider 40 between its first output 44 and second output 46, and the interconnecting coaxial cables. If the electrical length around the ring is an integral number of wavelengths at the frequency of the power source 18, the ring is resonant and standing waves appear on the ring. Power splits at the power divider 40 and travels in opposite directions around the ring to the inputs of the power coupling fixture 12. The power appearing at each input of the power coupling fixture 12 is partially absorbed by the discharge in the electrode-less lamp 10 and is converted to light and heat. The remainder of the input power is either reflected back toward the source or passes through the electrodeless lamp 10 and continues around the ring. The power flow in opposite directions results in the standing waves mentioned above.

The variable phase shifters 50 and 52 are effective to vary the electrical length of the ring. By adjustment of the variable phase shifters 50 and 52, it is possible to reduce the power reflected back to power source 18 essentially to zero and to make the electrical length of the ring equal to an integral number of wavelengths. An additional effect of the adjustment is to shift the position of the standing wave on the ring relative to electrodeless lamp 10. Optimum performance is achieved if a maximum in the current standing wave is located at the midpoint between the ends of electrodeless lamp 10. As the phase shifters are varied, the point of maximum arc intensity can be observed moving in electrodeless lamp 10. Thus, the arc distribution in the lamp can be controlled without changing the geometry of the power coupling fixture 12. Further, the variable phase shifters 50 and 52 are adjusted so that the reflected waves from the two inputs of the fixture 12 are out of phase and operate to cancel out the reflected power. Reflected power levels of less than 2% have been observed. A single variable phase shifter can be used in the ring to adjust the electrical length of the ring to an integral number of wavelengths. However, the reflected power at the input port is not minimized in this configuration. A scattering matrix analysis of the apparatus has been accomplished. The reflection coefficient at the input port is given by the following equation.

$$\rho_{in} = \rho_o + 2T^2 e^{-\Phi} \frac{1}{1 - (\rho_o + T) e^{-\Phi}}$$

where $\rho_{in}$=reflection coefficient at input port $\rho_o$=reflection coefficient at input port with both output ports matched T=transmission coefficient from input port to either output port $\Phi=\Phi'+L(\alpha+j\beta)$ $\alpha$=loop attenuation factor $\beta=2\pi/\lambda$ $\lambda$=wavelength at frequency of operation L=length around loop $\Phi'$=total phase shift added by variable phase shifters The loop attenuation factor, $\alpha$, is determined dominantly by the electrodeless lamp. The reflected power coefficient is $\rho_{in}^2$.

Figure 4:
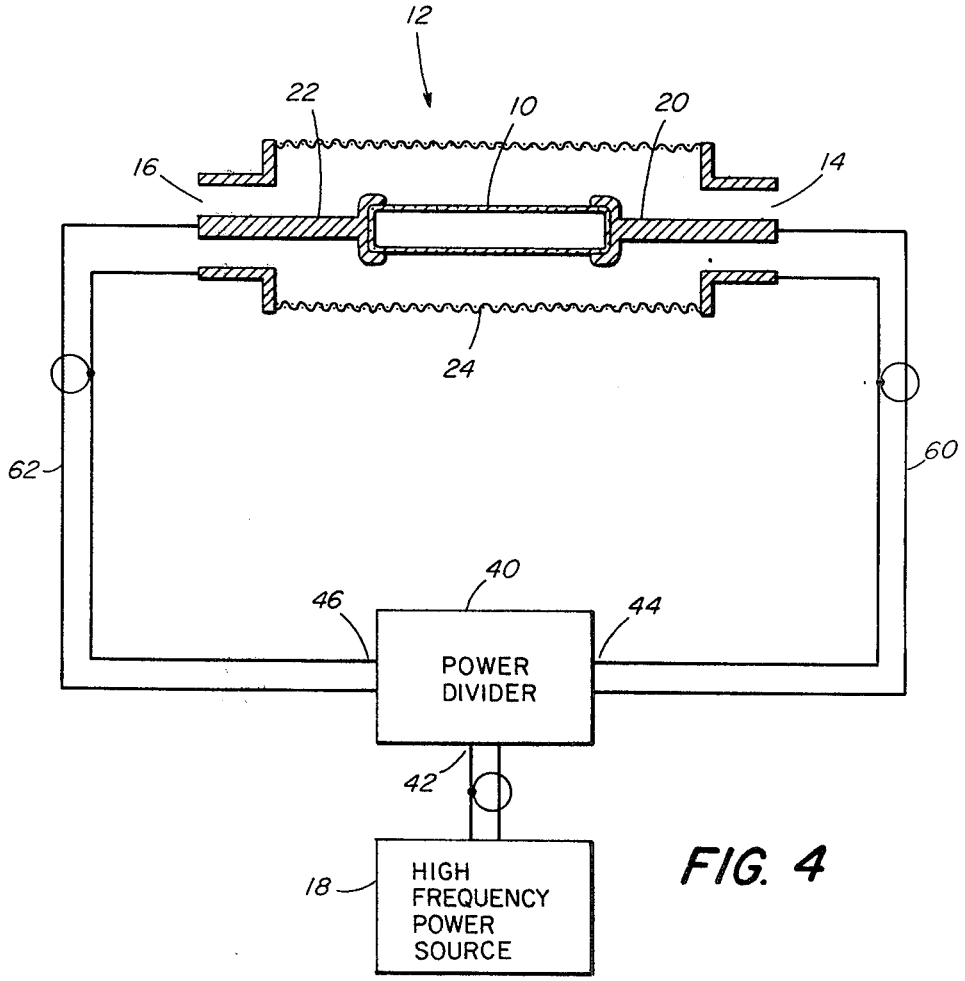
FIG. 4 is a sectional view of an electrodeless light source according to the present invention utilizing a resonant ring structure without variable phase shifters.

A resonant ring structure for double-ended excitation of electrodeless lamps can be constructed without the variable phase shifters shown in FIG. 3. Such a simplified apparatus is shown in FIG. 4. The first output 44 of power divider 40 is connected by transmission line 60 to the first input 14 of power coupling fixture 12 which encloses electrodeless lamp 10. The second output 46 of power divider 40 is connected by transmission line 62 to the second input 16 of power coupling fixture 12. High frequency power source 18 is coupled to the input 42 of power divider 40. Transmission lines 60 and 62 can be coaxial cables, waveguide, or other suitable transmission lines. The resonant ring in the present embodiment is formed by first conductor 20, electrodeless lamp 10, second conductor 22, power divider 40 between its first output 44 and second output 46, and transmission lines 60 and 62. In order to establish a resonant ring as described above without variable phase shifters, it is necessary to determine the electrical length of power coupling fixture 12, electrodeless lamp 10, and power divider 40. Then the lengths of transmission lines 60 and 62 are selected to make the electrical length of the ring equal to an integral number of wavelengths and to minimize the reflected power. Some configurations can require fixed phase shift elements (not shown) in series with transmission lines 60 and 62 if the required length is too long or too short to be practical. The present embodiment of the light source, since it requires only one power source and no variable phase shifters, can be made in a compact form using the power source shown in U.S. Pat. No. 4,070,603.

When power is supplied to both ends of an electrodeless lamp as disclosed in the present invention, not only is the arc shape more uniform and lengthened, but also the wall temperature distribution is more uniform over the length of the lamp. Thus, for a given input power level, hotspots are reduced and the electrodeless lamp can provide longer life. Alternatively, the lamp can be operated at a higher input power level before the maximum wall temperature is reached and a higher lumen output can be achieved for a given electrodeless lamp. Also, because the arc is lengthened, longer electrodeless lamps are practical. In addition, uniformity of wall temperature has the effect of reducing unwanted coldspots where fill material can condense and block light output by absorption.

The double-ended coupling to electrodeless lamps disclosed in the present invention also results in advantages in the high frequency power source. Useful solid state power devices at frequencies such as 915 MHz have a maximum state of the art power output of about 50 watts. By use of double-ended coupling, an electrodeless lamp can be operated at 100 watts input using a single oscillator with a power divider at the input of two 50 watt amplifiers.

While the present invention has been described in terms of an electrodeless light source, there are various other applications of the structure disclosed. For example, an electromagnetic discharge apparatus according to the present invention is useful for laser pumping applications or as an ion source. In addition, the invention is useful in plasma chemistry studies since plasma is produced by the apparatus. When used in plasma chemistry applications, the discharge vessel typically has an input and an output and the fill material is caused to flow through the discharge vessel.

While there has been shown and described what is at present considered the preferred embodiments of the invention, it will be obvious to those skilled in the art that various changes and modifications may be made therein without departing from the scope of the invention as defined by the appended claims.

What is claimed is:

1. An electromagnetic discharge apparatus comprising:

electrodeless discharge means including a discharge vessel having a first end and a second end and containing a fill material which supports electromagnetic discharge;

a power coupling fixture operative to couple high frequency power to both ends of said electrodeless discharge means so that said discharge means forms a termination load for said fixture during operation, said power coupling fixture including a first conductor having a first end coupled to the first end of said discharge vessel and a second end, a second conductor having a first end coupled to the second end of said discharge vessel and a second end, and an outer conductor disposed around said first and second conductors and said electrodeless discharge means, said outer conductor having a first end associated with the second end of said first conductor to form a first input for receiving said high frequency power and having a second end associated with the second end of said second conductor to form a second input for receiving said high frequency power;

first transmission circuit means having an output coupled to the first input of said power coupling fixture;

second transmission circuit means having an output coupled to the second input of said power coupling fixture;

power divider means having a first output coupled to an input of said first transmission circuit means, a second output coupled to an input of said second transmission circuit means; and a high frequency power source, coupled to an input of said power divider means, which delivers high frequency power having an associated wavelength, said first transmission circuit means, said first conductor, said electrodeless discharge means, said second conductor, said second transmission circuit means, and said power divider means between said first and second outputs forming an electrical loop having an associated electrical length, which is substantially equal to an integral number of said wavelengths.

2. The electromagnetic discharge apparatus as defined in claim 1 wherein said electrodeless discharge means includes an electrodeless lamp, said discharge vessel includes a lamp envelope made of a light transmitting substance, and said fill material emits light during electromagnetic discharge.

3. The electromagnetic discharge apparatus as defined in claim 2 wherein said first and second transmission circuit means include transmission line means.

4. The electromagnetic discharge apparatus as defined in claim 3 wherein said lamp has an impedance and wherein said apparatus further includes reactive impedance means associated with said power coupling fixture, said reactive impedance means being operative to match the impedance of said lamp during electromagnetic discharge to said high frequency power source.

5. The electromagnetic discharge apparatus as defined in claim 4 wherein said first and second conductors each have means at the first end thereof for controlling the electric field strength in a region adjacent to the interior wall of said lamp envelope to inhibit electromagnetic discharge within said region.

6. An electromagnetic discharge apparatus comprising:

electrodeless lamp means having a lamp envelope made of a light transmitting substance, said envelope having a first end and a second end and enclosing a fill material which emits light during electromagnetic discharge; and a power coupling fixture operative to couple high frequency power to said electrodeless lamp means so that said lamp means forms a termination load for said fixture during discharge, said power coupling fixture including a first conductor having a first end coupled to the first end of said lamp envelope and a second end, a second conductor having a first end coupled to the second end of said lamp envelope and a second end, and an outer conductor disposed around said first and second conductors and said electrodeless lamp means, said outer conductor having a first end associated with the second end of said first conductor to form an input for receiving high frequency power and being coupled to said second end of said second conductor so that a substantially uniform discharge is produced in said electrodeless lamp means.

7. The electromagnetic discharge apparatus as defined in claim 6 further including a high frequency power source coupled to the input of said power coupling fixture.

8. An electromagnetic discharge apparatus comprising:

electrodeless discharge means including a discharge vessel having a first end and a second end and containing a fill material which supports electromagnetic discharge;

a power coupling fixture operative to couple high frequency power to both ends of said electrodeless discharge means so that said discharge means forms a termination load for said fixture during operation, said power coupling fixture including a first conductor having a first end coupled to the first end of said discharge vessel and a second end, a second conductor having a first end coupled to the second end of said discharge vessel and a second end, and an outer conductor disposed around said first and second conductors and said electrodeless discharge means, said outer conductor having a first end associated with the second end of said first conductor to form a first input for receiving said high frequency power and having a second end associated with the second end of said second conductor to form a second input for receiving said high frequency power;

first transmission circuit means having an output coupled to the first input of said power coupling fixture and including first electrical length adjustment means;

second transmission circuit means having an output coupled to the second input of said power coupling fixture; and power divider means having a first output coupled to an input of said first transmission circuit means, a second output coupled to an input of said second transmission circuit means, and an input which is operative to receive high frequency power having an associated wavelength, said first transmission circuit means, said first conductor, said electrodeless discharge means, said second conductor, said second transmission circuit means, and said power divider means between said first and second outputs forming an electrical loop having an associated electrical length and said first electrical length adjustment means being adjusted so that the electrical length of said electrical loop is substantially equal to an integral number of wavelengths of said high frequency power.

9. The electromagnetic discharge apparatus as defined in claim 8 wherein said first electrical length adjustment means includes first variable phase shift means.

10. The electromagnetic discharge apparatus as defined in claim 8 further including a high frequency power source coupled to the input of said power divider means.

11. The electromagnetic discharge apparatus as defined in claim 10 wherein said electrodeless discharge means includes an electrodeless lamp, said discharge vessel includes a lamp envelope made of a light transmitting substance, and said fill material emits light during electromagnetic discharge.

12. An electromagnetic discharge apparatus comprising:

electrodeless discharge means including a discharge vessel having a first end and second end and containing a fill material which supports electromagnetic discharge;

a power coupling fixture operative to couple high frequency power to both ends of said electrodeless discharge means so that said discharge means forms a termination load for said fixture during operation, said power coupling fixture including a first conductor having a first end coupled to the first end of said discharge vessel and a second end, a second conductor having a first end coupled to the second end of said discharge vessel and a second end, and an outer conductor disposed around said first and second conductors and said electrodeless discharge means, said outer conductor having a first end associated with the second end of said first conductor to form a first input for receiving said high frequency power and having a second end associated with the second end of said second conductor to form a second input for receiving said high frequency power;

first transmission circuit means having an output coupled to the first input of said power coupling fixture and including first electrical length adjustment means;

second transmission circuit means having an output coupled to the second input of said power coupling fixture and including second electrical length adjustment means; and power divider means having a first output coupled to an input of said first transmission circuit means, a second output coupled to an input of said second transmission circuit means, and an input which is operative to receive high frequency power having an associated wavelength, said first transmission circuit means, said first conductor, said electrodeless discharge means, said second conductor, said second transmission circuit means, and said power divider means between said first and second outputs forming an electrical loop having an associated electrical length and said first and said second electrical length adjustment means being adjusted so that the electrical length of said electrical loop is substantially equal to an integral number of wavelengths of said high frequency power and so that the high frequency power reflected back to said input of said power divider means is minimized.

13. The electromagnetic discharge apparatus as defined in claim 12 wherein said first and said second electrical length adjustment means include first and second variable phase shift means, respectively.

14. The electromagnetic discharge apparatus as defined in claim 12 further including a high frequency power source coupled to the input of said power divider means.

15. The electromagnetic discharge apparatus as defined in claim 14 wherein said electrodeless discharge means includes an electrodeless lamp, said discharge vessel includes a lamp envelope made of a light transmitting substance, and said fill material emits light during electromagnetic discharge.

* * * * *